US007124529B1

(12) United States Patent
Havelka, Jr.

(10) Patent No.: US 7,124,529 B1
(45) Date of Patent: Oct. 24, 2006

(54) AXIALLY DISPLACED GUN STOCK RECOIL SYSTEM

(76) Inventor: Alfred J. Havelka, Jr., 124 Lazy La., Bandera, TX (US) 78003

( * ) Notice: Subject to any disclaimer, the term of this patent is extended or adjusted under 35 U.S.C. 154(b) by 21 days.

(21) Appl. No.: 11/013,570

(22) Filed: Dec. 16, 2004

(51) Int. Cl.
*F41C 23/08* (2006.01)
*F41C 23/06* (2006.01)

(52) U.S. Cl. ..... 42/74; 42/71.01

(58) Field of Classification Search ..... 42/74, 42/71.01; 89/44.01
See application file for complete search history.

(56) References Cited

U.S. PATENT DOCUMENTS 935,822 A * 10/1909 Schmidt ..... 42/74
2,344,752 A * 3/1944 Utz ..... 42/74
3,707,797 A 1/1973 Ruth ..... 42/74
3,795,998 A 3/1974 Kuhl ..... 42/74
5,375,360 A 12/1994 Vatterott ..... 42/74
6,481,143 B1 11/2002 McCarthy ..... 42/74

* cited by examiner

*Primary Examiner*—Michael J. Carone
*Assistant Examiner*—Bret Hayes
(74) *Attorney, Agent, or Firm*—Sturm & Fix LLP

(57) ABSTRACT

An axially displaceable gun stock recoil system (10) centered around an elongated axial shaft member (20) mounted for reciprocation relative to a butt plate member (30) having a threaded distal end (23) disposed within an elongated recess (101) in the butt of a gun stock (100) wherein, a pair of spring biasing elements (40) (50) of the butt plate member (30) and the main spring biasing element (40) is operatively disposed between the butt plate member (30) and a bearing plate member (60) that is received within a recoil pad (200).

4 Claims, 2 Drawing Sheets

AXIALLY DISPLACED GUN STOCK RECOIL SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of gun stock recoil systems in general, and in particular to an axially displaced gun stock recoil system that prevents binding engagement between the recoil pad and the butt of a gun stock.

2. Description of Related Art

As can be seen by reference to the following U.S. Pat. Nos. 3,795,998; 6,481,143; 5,375,360; and, 3,707,797, the prior art is replete with myriad and diverse gun stock recoil arrangements.

While all of the aforementioned prior art constructions are more than adequate for the basic purpose and function for which they have been specifically designed, they are uniformly deficient with respect to their failure to provide a simple, efficient, and practical gun stock recoil system that is axially displaceable along a single shaft that is mounted for reciprocation relative to the butt of a gun stock.

Virtually all of the aforementioned prior art gun stock recoil systems employ a plurality of laterally spaced spring biasing elements most of which are associated with shaft members that extend rearwardly from the butt portion of a gun stock and are operatively associated with a recoil pad or the like in a telescoping or quasi-telescoping relationship.

Unfortunately, the large number of operating components and the telescoping relationship of the recoil pad and gun stock represent a number of potential drawbacks, such as the cost of manufacture and likelihood of repair, as well as, the possibility that the telescoping components can become fouled with dirt and/or debris limiting, if not rendering useless, the desired operation of the recoil system.

As a consequence of the foregoing situation, there has existed a longstanding need among gun owners for a new and improved axially displaced gun stock recoil system that is relatively inexpensive and easy to install and repair due to its single axis design which physically spaces the recoil pad from the gun stock butt, and the provision of such a construction is a stated objective of the present invention.

BRIEF SUMMARY OF THE INVENTION

Briefly stated, the gun stock recoil system that forms the basis of the present invention comprises in general an axial shaft member mounted for reciprocation relative to the butt-end of a gun stock via a butt plate member and a pair of spring biasing elements disposed on the opposite sides of the butt plate member wherein, one end of the axial shaft member is adapted to reciprocate within a recess formed in the butt portion of the gun stock and the other end of the axial shaft member is fixedly secured to a backing plate that is fixedly secured to a recoil pad.

In addition, one of the pair of spring biasing elements comprises a heavy main spring biasing member disposed intermediate the butt plate member and the backing plate member wherein, the other spring biasing element comprises an auxiliary light spring biasing member that is disposed on the other side of the butt plate member and an adjustable bearing washer the position of which can be varied to adjust the overall recoil absorbing effect of the recoil system, as will be explained in greater detail further on in the specification.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
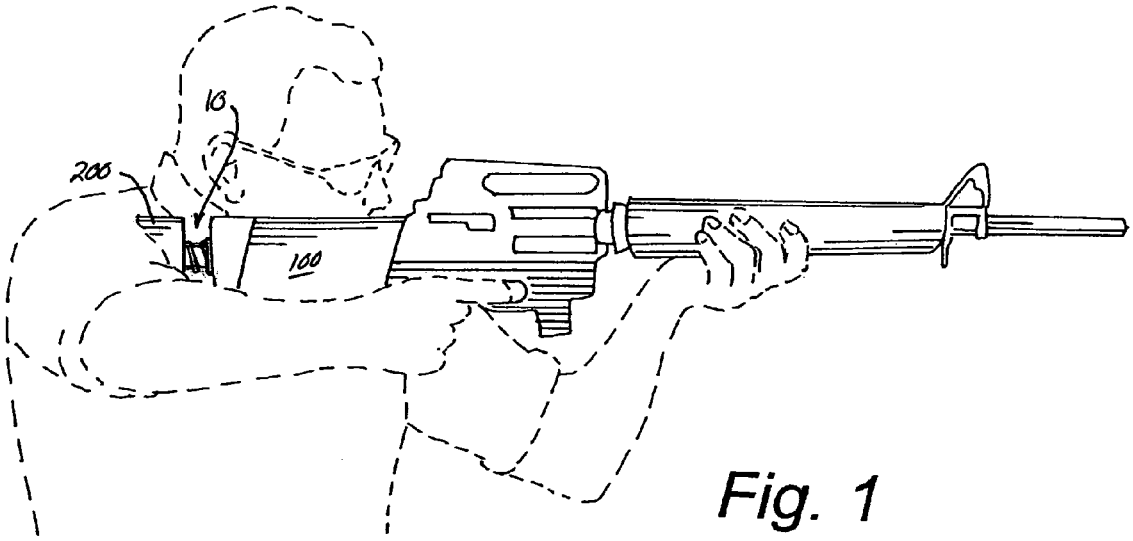
FIG. 1 is a perspective view of a firearm equipped with the gun stock recoil system that forms the basis of the invention in use.
Figure 4:
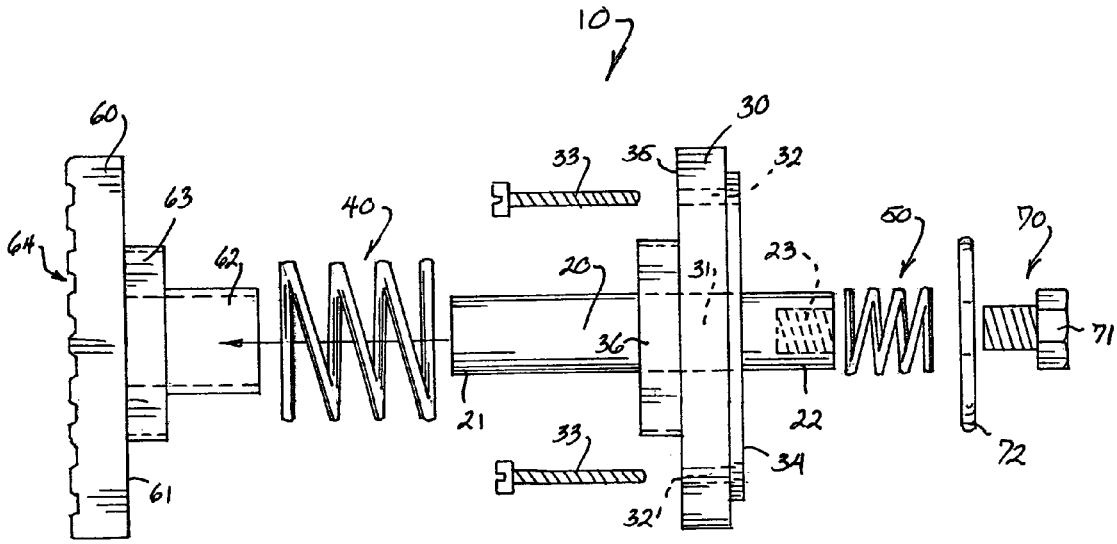

As can be seen by reference to the drawings, and in particularly to FIGS. 1 and 4, the gun stock recoil system that forms the basis of the present invention is designated generally by the reference number 10. The recoil system comprises in general an elongated axial shaft member 20 having a generally square cross-sectional configuration that is slidably disposed in a complementary dimensioned butt plate member 30 wherein, a pair of spring biasing elements 40 50 are disposed in a surrounding manner on the axial shaft member 20 on opposite sides of the butt plate member 30.

In addition, the distal end 21 of the axial shaft member 20 is fixedly secured in a bearing plate member 60 and the proximal end 22 of the axial shaft member 20 is threaded as at 23 and adapted to receive a spring tension adjustment mechanism 70 including a threaded bolt 71 and a bearing washer 72 the purpose and function of which will be described in greater detail further on in the specification.

Figure 3:
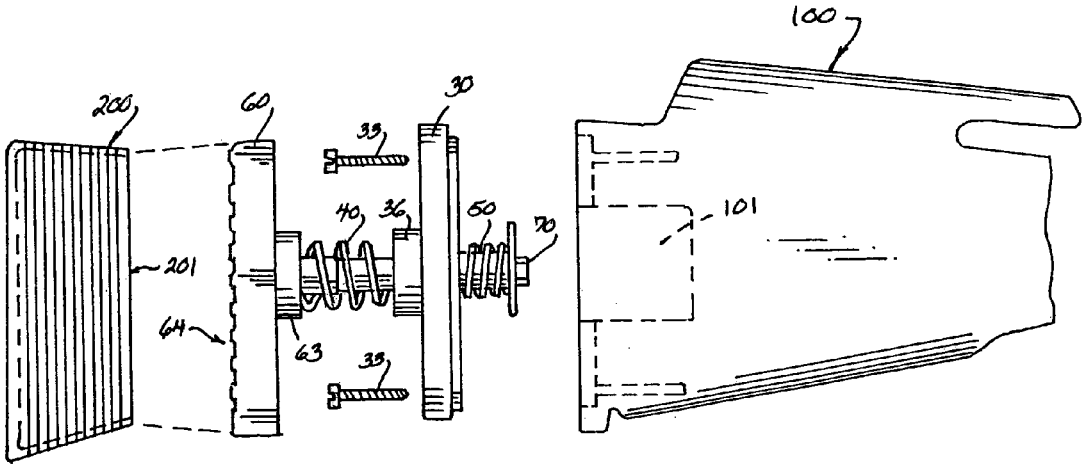
FIG. 3 is an exploded perspective view of the recoil system disposed intermediate the recoil pad and the gun stock butt; and, FIG. 4 is an exploded perspective view of the components of the gun stock recoil system.

Turning now to FIGS. 3 and 4, it can be seen that the butt plate member 30 has a generally square central aperture 31 dimensioned to slidably receive the axial shaft member 20 and a plurality of discrete spaced apertures 32 32 dimensioned to receive a like plurality of threaded fasteners 33 33 for securing the butt plate member 30 to the butt of the gun stock 100 wherein, an enlarged recess 101 is formed in the gun stock butt 100 to receive the proximal end 22 of the shaft member 20, as well as, the auxiliary spring biasing element 50 and the spring tension adjustment mechanism 70.

Furthermore, the auxiliary spring biasing element 50, which is preferably a lightweight spring rated approximately at 10–15 pounds of spring resistance, is captively disposed between the inboard face 34 of the butt plate member 30 and the bearing washer 72 of the spring tension adjustment mechanism 70 wherein, the engagement of the threaded bolt 71 with the threaded proximal end 23 of the axial shaft member 20 to pre-load the resistance of the auxiliary spring biasing element 50.

Still referring to FIGS. 3 and 4, it can be seen that the outboard face 35 of the butt plate member 30 is further provided with a first spring retention collar 36 that captively receives one end of the main spring biasing element 40, which is preferably a heavyweight spring rated at approximately 50–55 pounds of spring resistance. Furthermore, the inboard face 61 of the bearing plate member 60 is provided with a receptacle element 62 that is fixedly connected to the proximal end 21 of the axial shaft member 20 and surrounded by a second spring retention collar 63 that captively receives the other end of the main spring biasing element 40.

As can also be appreciated by reference to FIGS. 3 and 4, the outboard face 64 is ribbed and dimensioned to be received in the open mouth 201 of a recoil pad 200 to complete the installation of the axially displaceable gun recoil system 10 on a firearm.

Figure 2:
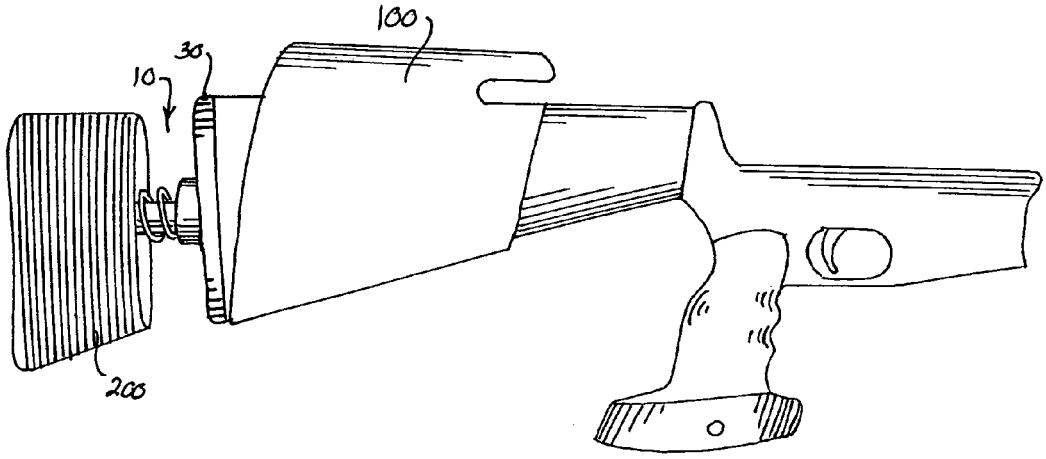
FIG. 2 is an isolated side elevation view of the firearm receiver equipped with the gun stock recoil system.

Turning now to FIGS. 1 and 2, it can be seen that the gun recoil system 10 of this invention axially offsets the recoil pad 200 a substantial and visible distance away from the butt plate 30 that is secured to the butt of the gun stock 100 which not only produces a dramatic and unique aesthetic impression, but also substantially minimizes the potential for any physical contact between the recoil pad 200 and the butt plate member 30 such that the recoil from a weapon such as an AR-15 50 BMG rifle will be reduced by approximately 75% to 80%, substantially increasing the comfort levels experienced by a shooter and prolonging the time that can be effectively spent on a shooting range or the like.

It should further be noted that by employing a single elongated axial shaft member 20, this recoil system 10 has a structural rigidity and integrity that far exceeds the capabilities of the multi-shafted arrangements prominently taught and suggested in the prior art patents.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

The invention claimed is:

1. A gun recoil system operatively connected between a recoil pad and the butt of a gun stock and comprising:

a single elongated axial shaft member have a proximal end and a distal end;

a bearing plate member operatively connected on the proximal end of the axial shaft member;

a butt plate member adapted to slidably receive said axial shaft member and including means for attaching the butt plate member to the butt of a gun stock;

a plurality of spring biasing elements disposed on the opposite sides of the butt plate member and in a surrounding relationship relative to said axial shaft member;

wherein, the distal end of the axial shaft member is provided with a spring tension adjustment mechanism that engages one of said plurality of spring biasing elements that is disposed intermediate the butt plate member and the spring tension adjustment mechanism;

wherein, a remainder of the plurality of spring biasing elements is disposed intermediate the butt plate member and the bearing plate member; and wherein, the distal end of the axial shaft member is threaded and the spring tension adjustment mechanism comprises a threaded bolt and a bearing washer that captivley engage said one of the plurality of spring biasing elements between the butt plate member and the bearing washer.

2. The recoil system as in claim 1; wherein, the butt plate member has an outboard face provided with a first spring retention collar and the bearing plate member has an inboard face provided with a second spring retention collar wherein, both of said spring retention collars engage opposite ends of said remainder of the plurality of spring biasing elements.

3. The recoil system as in claim 2; wherein, the second of the plurality of spring biasing elements is rate at approximately 50–55 pounds of spring resistance.

4. The recoil system as in claim 3; wherein, the first of the plurality of spring biasing elements is rated at approximately 10–15 pounds of spring resistance.

* * * * *